United States Patent [19]

Tadiotto

[11] Patent Number: 4,742,626

[45] Date of Patent: May 10, 1988

[54] GOLF SHOE SOLE

[75] Inventor: Guilio Tadiotto, Nurnberg, Fed. Rep. of Germany

[73] Assignee: Adidas Sportschuhfabriken Adi Dassler Stiftung & Co. KG, Fed. Rep. of Germany

[21] Appl. No.: 38,991

[22] Filed: Apr. 16, 1987

[30] Foreign Application Priority Data

Jul. 12, 1986 [DE] Fed. Rep. of Germany ... 8618748[U]

[51] Int. Cl.[4] ..... A43B 5/00

[52] U.S. Cl. ..... 36/127

[58] Field of Search ..... 36/103, 113, 114, 124, 36/127, 134, 30 R, 30 A, 31, 59 R, 59 B, 59 C, 28

[56] References Cited

U.S. PATENT DOCUMENTS

| | | | |
|---|---|---|---|
| 2,238,477 | 4/1941 | Murber | 36/127 X |
| 2,315,874 | 4/1943 | Sabel et al. | 36/127 |
| 2,416,526 | 2/1947 | Koenig | 36/127 |
| 3,311,999 | 4/1967 | MacNeill | 36/127 |
| 4,562,651 | 1/1986 | Frederick et al. | 36/25 R X |

FOREIGN PATENT DOCUMENTS

| | | | |
|---|---|---|---|
| 541725 | 4/1956 | Italy | 36/127 |
| 667711 | 3/1952 | United Kingdom | 36/127 |

*Primary Examiner*—Donald Watkins

[57] ABSTRACT

A golf shoe sole has a plurality of inserts for releasably mounting gripping elements therein. The inserts are arranged in the front part of the sole in a first line adjacent the outside edge of the sole and a second line adjacent the inside edge of the sole. Associated with those two lines of inserts, at least one further insert, or a further group of inserts, is arranged at a position towards the longitudinal center line of the sole, relative to each of the first and second lines of inserts. The further insert or group of inserts associated with the first line adjacent the outside edge of the sole is disposed in the region of the sole which extends from the outside ball area of the sole to the arch portion of the sole.

8 Claims, 1 Drawing Sheet

GOLF SHOE SOLE

BACKGROUND OF THE INVENTION

Golf shoe soles customarily include a substantial number of inserts therein, in the form of sleeves or bushes having a female screwthread therein for screwthreadedly and releasably fixing respective gripping elements such as studs or spikes to the sole. The inserts are usually arranged both on the front portion of the sole, where the front part of the foot including the ball thereof is supported, and the heel portion of the sole. The inserts in the front portion of the sole may be divided into first and second groups extending along two lines adjacent to respective edges of the sole, with one line of inserts thus approximately following the contour of the inside edge of the sole while the other line approximately follows the contour of the outside edge of the sole. A golf shoe sole of that kind may be found for example in the adidas catalogue for 'Shoes', marketing program, Apr. 1, 1980. The golf shoe sole disclosed therein has a ground-engaging side, namely the underside thereof, which is flat throughout, being therefore without a raised heel configuration.

Another golf shoe sole of generally the same kind is also to be found in German laid open application (DE-OS) No 31 20 349 in which the arrangement of the inserts for releasably fixing the gripping elements is different on the soles of each of the shoes forming a pair, more specifically being such that a larger number of inserts for carrying gripping elements is associated with the edge of the sole which is the front edge when considering the direction in which a ball is struck by the person wearing the shoes. For example, when considering a right-handed player, the front edge of the sole of the left foot is the outside edge of that sole, while the front edge of the sole of the shoe on the right foot is the inside edge. That design configuration is based on the idea that it is those edges of the soles which are required to have particularly good grip against the ground during a golf swing, and that effect is achieved by the presence of the above-mentioned larger number of gripping elements at the respective edges in question, as well as the fact that the entire respective edge of the sole is fitted with inserts for receiving gripping elements, from the tip thereof continuously to the heel region. However, that arrangement of gripping elements means that it is uncomfortable to walk about when wearing golf shoes having soles of that nature. In addition, it is necessary to provide a separate stock of golf shoes which are thus of a suitable sole configuration for right-handed players and left-handed players respectively.

SUMMARY OF THE INVENTION

An object of the present invention is to provide a golf shoe sole which gives enhanced flexibility in regard to the fitting of gripping elements or studs.

Yet another object of the present invention is to provide a golf shoe sole which permits the grip thereof which is afforded by gripping elements carried on the sole to be better adapted to the rolling movement of the sole towards the side, which takes place during a golf swing.

Still another object of the present invention is to provide a sole for a golf shoe, which is adapted to give better grip with the ground when the shoe takes up positions of varying inclination and attitude with respect to the ground.

In accordance with the principles of the present invention these and other objects are achieved by a golf shoe sole comprising a plurality of inserts for releasably fixing gripping elements therein. Inserts are arranged on a front portion of the sole in first and second groups extending along respective lines adjacent to and approximately following the contour of respective ones of the inside and outside edges of the sole. In addition to the first and second groups of inserts on the front portion of the sole, the sole also carries a further insert, or a further group of inserts, associated with each of the first and second groups of inserts. Each said further insert or group thereof is displaced relative to the respectively associated one of the first and second groups towards the longitudinal centre line of the sole. Each further insert or group of inserts is provided in a region extending from the outside ball area of the sole to the arch portion thereof.

The underlying consideration of the invention is that the concentration of loading through the sole, at what is referred to as the 'pressure area', is concentrated approximately in the outside ball region of the sole in the case of the golf shoe which is the front or leading shoe in the direction in which the golf ball is struck, and approximately in the toe region in the case of the golf shoe which is the rearward or trailing shoe in the direction of striking the ball. For that reason, at least in the two outside ball regions of the golf shoe sole, directly adjacent to the group of inserts disposed at that area but displaced with respect thereto towards the centre line of the sole, the sole according to the invention carries at least one further insert or a further group of inserts. Thus, the further insert or further group of inserts provides for a concentration of grip against the ground precisely in the important pressure area as referred to above, insofar as in that area the array of gripping elements is extended over the surface of the sole towards the centre thereof.

In a preferred feature, inserts or further groups of inserts are also provided in the two toe regions, as far as the inside ball areas, so that gripping elements can also be suitably fixed in position at those locations.

As the soles in accordance with the invention of a pair of golf shoes are of mirror image configuration relative to each other and as the gripping elements can be releasably fixed in the appropriate inserts, the golfer, depending on whether he is right-handed or left-handed, has the option of using the respective arrangement of gripping elements which suits his individual requirements and which is differet on the sole of one shoe of a pair in relation to the sole of the other shoe of the pair. Those further inserts or group of inserts which are not required, depending on whether the player using the shoes is a right-handed player or a left-handed player, can be closed off by fitting blind screws therein, that is to say, screws with a cap which therefore do not provide a gripping element. In that way it is possible for the golf shoe sole to be adapted to the specific requirements of each individual golfer, in spite of all the golf shoes being of the same basic configuration.

Further objects, features and advantages of the present invention will be apparent from the following description.

DESCRIPTION OF THE PREFERRED EMBODIMENT

Figure 1:
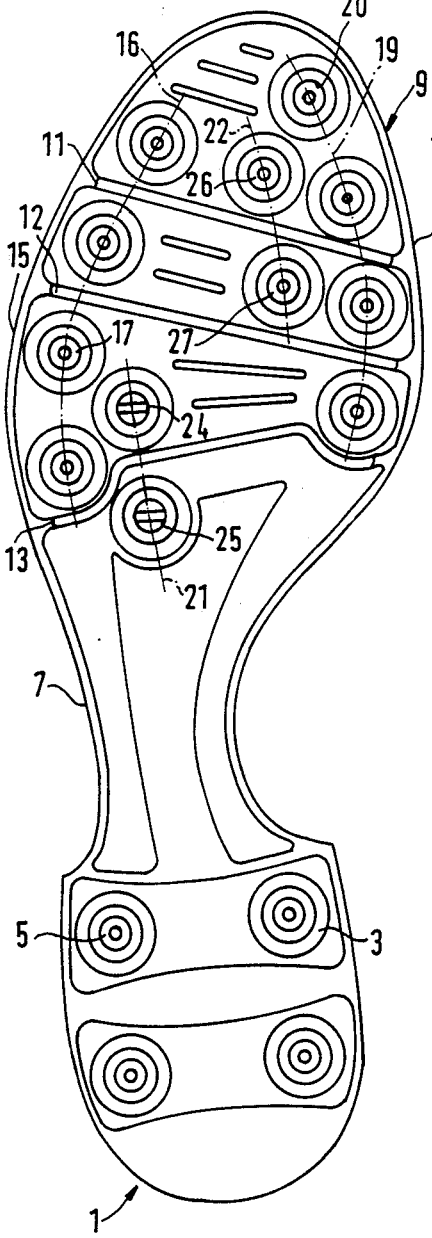
FIG. 1 is a view from below of the sole of the right-hand golf shoe of a pair.
Figure 2:
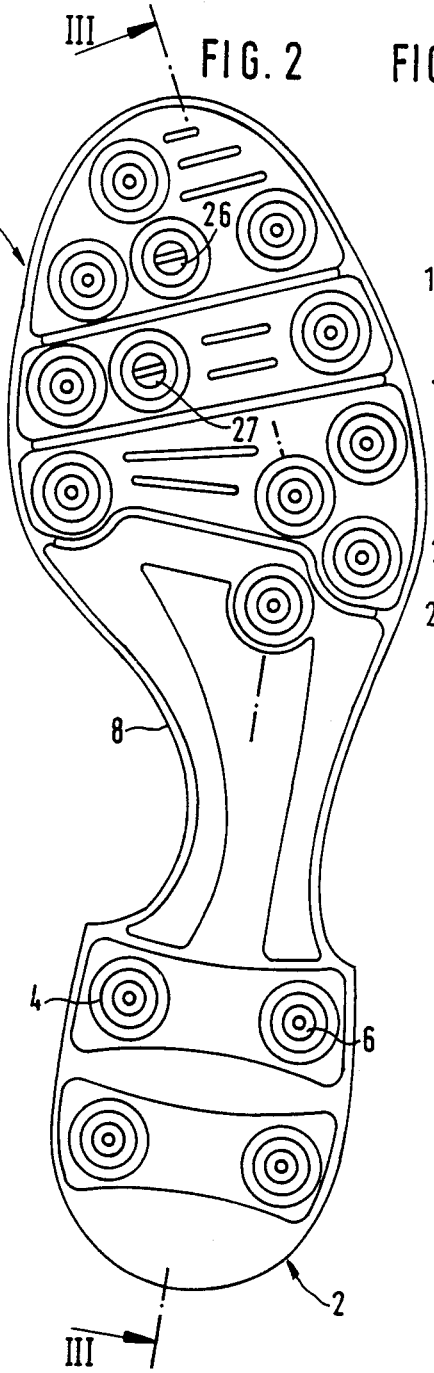
FIG. 2 is a view from below of the sole of the left-hand golf shoe of the same pair.

Referring firstly to FIGS. 1 and 2, the pair of golf shoe soles shown therein are provided with gripping elements or studs for a right-handed golfer. For that purpose, blanking screws are fitted in some of the mounting inserts therein, and indicated at 24 and 25 in FIG. 1 and at 26 and 27 in FIG. 2 respectively, to which more detailed reference will be made below. The other inserts thus carry the usual form of gripping elements, studs, spikes or the like.

Each of the soles 1 and 2 shown in FIGS. 1 and 2 respectively forms the actual outside or wearing sole which is secured to the underneath surface of an intermediate sole portion comprising for example flexible plastic material such as foamed polyurethane. The soles 1 and 2 each comprise a plate portion of comparatively hard plastic material, for example polyamide which has been set has a hard material but which is still flexible. In addition, the soles 1 and 2 each have a ground-engaging surface which is continuous from the front end or tip of the sole (upwardly in FIGS. 1 and 2) to the heel portion thereof, that is to say, the illustrated soles do not have any form of stepped heel. As shown however, in the heel area of each sole, the sole has two transversely extending bridge portions 3 and 4 respectively which are produced by an increased thickness of material, at which four screwthreaded inserts are directly embedded into the plastics plate of the respective sole, for fixing gripping elements therein.

Figure 3:
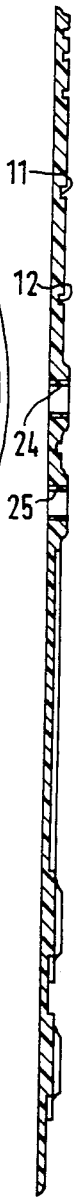
FIG. 3 is a view in longitudinal section taken along line III—III in FIG. 2, but for reasons of enhanced clarity of the drawing omitting the raised portions which would be provided on the front part of the sole, for fixing gripping elements therein, unless such raised portions lie on the section line III—III.

The raised configuration of the bridge portions 3 and 4 can be clearly seen from the cross-sectional view in FIG. 3.

Referring still to FIGS. 1 and 2, the arch region 7 and 8 of each of the two soles 1 and 2 is strengthened by increased thicknesses of material at the respective edges thereof, while the front sole portions 9 and 10 are stiffened throughout by virtue of an increased thickness of material and only have transversely extending grooves or channels as indicated at 11 through 13 which form local weakened areas which thus provide bending locations to permit the front portion of each sole to bend and flex more easily. While the two front grooves 11 and 12 in each front sole portion 9 and 10 extend at least substantially parallel to each other, the rearward and third groove 13 on each sole extends in outwardly diverging relationship, that is to say outwardly in relation to the outside edge as indicated at 15 of the respective sole, so that the grooves 12 and 13 define a generally sector-shaped region of the sole at the rearward end of the front sole portion 9 or 10 respectively. One of the above-mentioned pressure areas of the sole is to be found in the vicinity of the outward edge of the respective sole, as indicated at 15 in FIG. 1, in the above-mentioned sector-shaped region thereof. As the two soles 1 and 2 of a pair of golf shoes are of mirror image configuration relative to each other, in regard to the arrangement of inserts for releasably fixing gripping elements on the front portion 9 or 10 of the sole, only the right-hand sole 1 shown in FIG. 1 will be described in greater detail hereinafter.

Referring therefore to FIG. 1, reference numeral 16 therein denotes an imaginary line which extends adjacent to and approximately follows the contour of the outside edge 15 of the front portion 9 of the sole, being disposed for example at a spacing of 1.3 centimeters therefrom. Arranged on the imaginary line 16 at at least substantially equal spacings from each other are the centre points of screwthreaded inserts 17 for fitting gripping elements therein. As mentioned, the line 16 follows at last approximately the outside contour of the front portion 9 of the sole, being therefore substantially parallel to or at a substantially constant spacing from the outside edge 15.

Similarly, reference numeral 19 in FIG. 1 denotes another imaginary line which also extends at least substantially parallel to or at an equal distance from the inside edge of the front portion 9 of the sole, as indicated at 18. The centre points of further screwthreaded inserts 20 for releasably fixing gripping elements are likewise arranged along the line 19, at at least substantially equal spacings from each other.

The groups each consisting of four inserts 17 and 20 respectively, which are associated with the outside edge 5 and the inside edge 18 respectively of the front portion 9 of the sole, thus form first and second groups of inserts arranged in a generally usual manner.

In accordance with the invention, in addition to the first and second groups of inserts extending along the lines 16 and 19, the sole further includes at least one further insert or group of inserts, respectively associated with each of the first and second groups of inserts. Thus, looking still at FIG. 1, reference numeral 21 therein denotes a further imaginary line which extends at least approximately parallel to the line 16 in the rearward end region thereof, adjoining the arch portion 7 of the sole, while reference numeral 22 denotes a further imaginary line which extends at least substantially parallel to the line 19 adjacent the front region thereof, thus towards the tip of the sole 1. Arranged on the line 21 are the centre points of a further group consisting of two screwthreaded inserts which are illustratd as accommodating the screws 24 and 25 referred to above. Similarly, disposed on the line 22 are the centre points of two screwthreaded inserts as indicated at 26 and 27. The arrangement of those further groups of inserts as indicated at the locations identified by references 24, 25, 26 and 27 is such that the rearward insert as identified at 25 of the further group of inserts associated with the line of inserts 16 adjacent the outside edge 15 of the front portion 9 of the sole lies rearward of the groove 13 while the other insert as indicated at 24 of that group is in front of the groove 13.

In addition, the two inserts 26 and 27 on the line 22, which are associated with the group of inserts on the line 19 associated with the inside edge of the front portion 9 of the sole, are disposed in the sole region which extends from the inside ball region thereof to the tip of the sole; the rearward insert 27 is disposed at a location corresponding to the inside ball area itself.

It will be further noted that the inserts at locations indicated by reference 24, 25 and 26, 27 respectively of the first and second further groups of inserts are arranged in staggered relationship with respect to the inserts disposed on the respective lines 16 and 19, so that for example the inserts on the line 26 and 27 are aligned with gaps between the adjacent inserts on the line 19. In that way the above-mentioned pressure areas in the corresponding region can be covered by gripping elements over at least a substantial part of the surface area thereof, thus affording an enhanced grip.

With the above-described configuration of the soles 1 and 2, for use by a right-handed golfer, the inserts at the locations identified as 24 and 25 on the sole 1 shown in FIG. 1 and the inserts 26 and 27 on the sole 2 shown in FIG. 2 will not be fitted with gripping elements or studs. Instead of gripping elements, those inserts will receive blind or blanking screws, as shown in FIGS. 1 and 2 by the slotted screw heads to which reference numerals 24, 25, 26 and 27 are respectively directed. That means that the pattern of gripping elements used on the respective soles 1 and 2 of a pair of golf shoes in the condition of use thereof in which they are adapted to the needs of a right-handed golfer, differ from one sole to the other, namely a larger number of gripping elements, being six elements in the illustrated situation, is provided at and adjacent to the inside edge 18 of the sole shown in FIG. 1, than at the outside edge 15 thereof. The situation is reversed in the case of the sole 2 shown in FIG. 2, in which six gripping elements are positioned at or adjacent to the outside edge of the sole while the lower number of gripping elements, namely only four thereof, is disposed at the inside edge of the sole.

While the present invention is described and illustrated herein with specific reference to a preferred embodiment, it will be appreciated that various modifications and alterations may be made therein without thereby departing from the spirit and scope of the invention.

I claim:

1. A golf shoe sole comprising: a plurality of inserts for releasably fixing gripping elements, which inserts are arranged in a front portion of the sole in first and second groups along first and second lines adjacent to and approximately following the contour of respective ones of the outside and inside edges of the sole; and further including at least two further inserts arranged beside respective ones of said first and second groups and displaced relative to the respectively associated first and second groups towards the longitudinal center line of the sole, said at least two further inserts thereby constituting a respective group of further inserts, said group of further inserts associated with said group adjacent to said outside edge of the sole being disposed in a region of the sole extending from the outside ball area thereof to the arch portion thereof.

2. A sole as set forth in claim 1 wherein each said group of further inserts is disposed substantially on a line which extends substantially parallel to the line of inserts of the respectively associated first and second group.

3. A sole as set forth in claim 2 wherein each said group of further inserts is arranged in staggered relationship with the inserts of the respectively associated first and second groups.

4. A sole as set forth in claim 1 wherein said group of further inserts associated with said group along said inside edge of the sole is provided in the region of the sole which extends from the inside ball area to the tip of the sole.

5. A sole as set forth in claim 1 and including a weakening line adapted to facilitate bending of the sole extending to the rear of the rearmost insert of each of said first and second group of inserts approximately transversely with respect to the longitudinal direction of the sole, and wherein at least one insert of said group of further inserts associated with said first group along said outside edge of the sole is disposed rearwardly of said weakening line.

6. A sole as set forth in claim 1 and including blanking screws for closing off one of said groups of further inserts when same is not to be fitted with respective gripping elements.

7. A golf shoe sole having a front end and a rear end and providing a front portion extending from said front end to a portion rearwardly of the ball of a foot supported in use on said sole, a heel portion which provides said rear end and which is adapted to support the heel of a foot supported in use on said sole, and an arch portion forming the connection between said front portion and said heel portion, comprising: a plurality of inserts in said front portion of said sole arranged in a first group extending substantially along the outside edge of said front portion of the sole and a second group extending substantially along the inside edge of said front portion of the sole, adapted to receive gripping elements therein; at least two first further inserts disposed adjacent to one another and adjacent to said first group of inserts at the side thereof remote from said outside edge of said front portion of the sole, and in a part of said front portion of the sole extending from the area of said front portion which is adapted to support the ball of a foot supported in use on said sole to the front part of said arch portion of said sole; and at least two second further inserts disposed in said front portion of the sole adjacent to one another and adjacent said second group of inserts at the side thereof remote from said inside edge of said front portion of the sole.

8. A sole as set forth in claim 1 wherein each insert of said at least two further inserts is arranged in staggered relationship with the inserts of the respectively associated first and second groups.

* * * * *